US005088372A

United States Patent [19]

Lund et al.

[11] Patent Number: 5,088,372

[45] Date of Patent: Feb. 18, 1992

[54] SLICER BLADE FOR CYLINDRICAL POTATO STRIPS

[76] Inventors: Michael E. Lund, 15050 Keno-Worden Rd.; William L. Sharrar, 3840 Crest, both of Klamath Falls, Oreg. 97603

[21] Appl. No.: 726,326

[22] Filed: Jul. 5, 1991

[51] Int. Cl.[5] ..... B26D 1/02

[52] U.S. Cl. ..... 83/858; 83/402; 83/857

[58] Field of Search ..... 83/857, 858, 437, 402, 83/420, 446, 620

[56] References Cited

U.S. PATENT DOCUMENTS

| | | | |
|---|---|---|---|
| 1,112,991 | 10/1914 | Dufner | 83/857 |
| 2,692,630 | 10/1954 | Doolin | 83/857 X |
| 2,836,212 | 5/1958 | Shaw | 83/620 |
| 3,057,386 | 10/1962 | Massaro | 83/356.1 |
| 3,687,688 | 8/1972 | Stapley et al. | 83/865 X |

FOREIGN PATENT DOCUMENTS

| | | | |
|---|---|---|---|
| 0398939 | 9/1933 | United Kingdom | 83/857 |

*Primary Examiner*—Douglas D. Watts

*Assistant Examiner*—Clark F. Dexter

*Attorney, Agent, or Firm*—John F. Ingman

[57] ABSTRACT

A slicer blade for cylindrical potato strips includes a plate member having a plurality of closely spaced cylindrical holes formed therein. The edge of each hole is beveled, as by a countersinking-type bit, preferably with the beveling tool being inserted into each hole the same distance, so that the surface of the bevel at least reaches the center point of the triangular space between each cluster of three holes. The previously flat triangular space thus is transformed into a three-sided sharp pointed peak. Additionally, the beveling creates an edge between the holes which also becomes sharpened to the same slope or angle as the peak. The edge between each pair of adjcent holes is formed into a concave shape which curves upward to the sharp-pointed peak. The combination of closely positioned holes and the beveling of each hole produces a sharp cutting edge about the perimeter of each hole without leaving any surface of the slicer blade which is transverse to the flow of the potato. A preferred arrangement of slicer holes is hexagonal, but is not so limited.

9 Claims, 2 Drawing Sheets

SLICER BLADE FOR CYLINDRICAL POTATO STRIPS

BACKGROUND OF THE INVENTION

1. Field of the Invention

This invention involves a slicer blade for potatoes, and, more particularly, a slicer blade which creates cylindrical potato strips for a fried potato product.

2. Description of the Prior Art

Cylindrical French fried potatoes are believed to be a superior product to conventional French fries in that an elongated fried potato product of round cross section is disposed to more even cooking and less oil consumption, and thus better taste. However the preparation of cylindrical potato strips for deep fat frying has been faced with the problem that, within a slicer blade, a grouping of round slicing elements presents a roughly triangular area between each cluster of three round slicing elements which effectively hinders efficient passage of the Potato therethrough, either creating waste or requiring excessive "pusher" pressure. A previous attempt to create cylindrical potato strips is found in U.S. Pat. No. 3,687,688 issued to R. F. Stapley et al, wherein a potato is subjected to multiple separate corings, the corings being sufficiently separated from each other so that a cored potato hulk remains which is subsequently transversely sliced so that it may be used in a second deep fried potato product in the form of a perforated slice. U.S. Pat. No. 3,057,386, issued to Q. H. Massaro, utilizes concentric cutting tubes to form a single cylindrical potato core and a shell ring, both of which may subsequently be transversely sliced, or the cylindrical core left intact for deep fat frying as a potato stick of round cross section.

What is needed is a slicer blade for the cutting of cylindrical potato strips which will provide a plurality of cylindrical potato strips from a single potato with a minimum of waste and of pressure required to force a potato through the slicer blade.

SUMMARY OF THE INVENTION

The present invention involves a slicer blade for cylindrical potato strips which has been designed to meet the aforementioned need.

Accordingly, in the preferred embodiment, the slicer blade for cylindrical potato strips includes a plate member having a plurality of closely spaced cylindrical holes formed therein. The undesirable flat surface area between the holes, and particularly the roughly triangular space between each set of three holes, which would impede the efficient Passing through of a Potato, is eliminated by beveling the edge of each hole, as with a countersinking-type bit. The beveling tool is inserted into each hole the same distance so that it at least reaches the center point of the triangular space. The triangular space thus is transformed into a three-sided sharp pointed peak. Since insertion of the beveling tool creates lateral beveling which is greater than the distance separating adjacent holes, the edge between the holes also becomes sharpened to the same slope or angle as the peak. Additionally, the edge between each pair of adjacent holes is formed with a concave shape which extends upward to the sharp-pointed peak.

Thus a combination of closely positioned holes and the beveling of each hole produces a sharp cutting edge about the perimeter of each hole without leaving any surface of the slicer blade which is transverse to the flow of the potato. Individual cylindrical potato strips therefore are cut for the entire potato with no internal waste.

A preferred arrangement of slicer holes is hexagonal but is not so limited. The means of forcing the potato through the slicer blade will vary according to usage, from a simple mechanical leverage device utilizing a pusher element which may penetrate the cylindrical holes in the slicer blade, to a more complex hydraulic pressure system as used in commercial French fried potato preparation.

DESCRIPTION OF THE PREFERRED EMBODIMENTS

Figure 1:
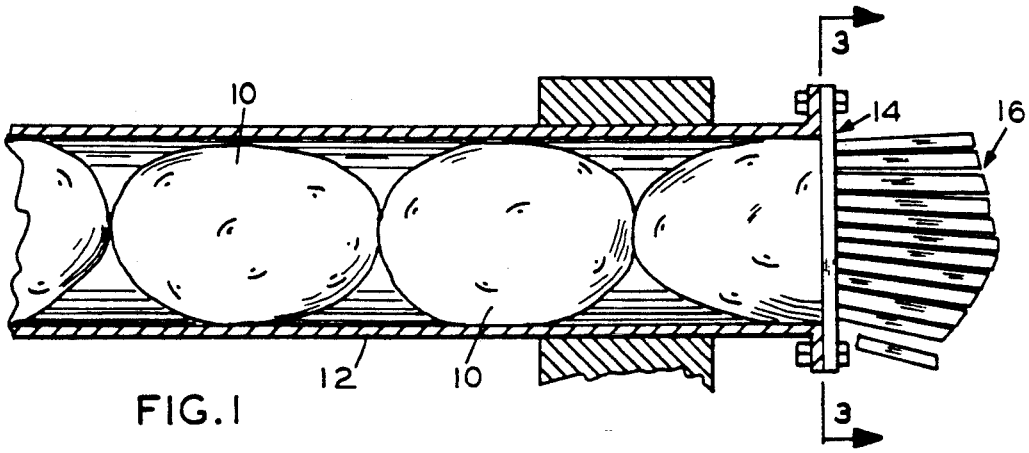
FIG. 1 illustrates a schematic view of the slicer blade in use in a hydraulic commercial type potato strip operation.
Figure 2:
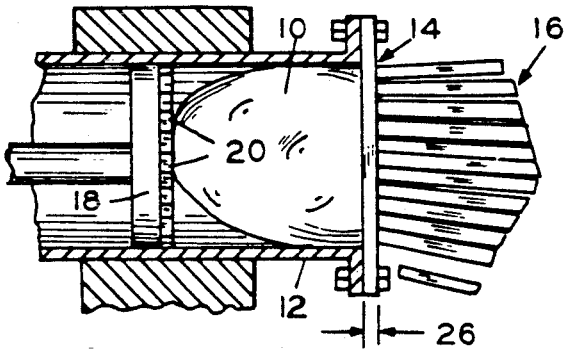
FIG. 2 illustrates a schematic view of the slicer blade in use in a mechanical type potato strip operation.

Turning now to the drawings, there is shown in FIG. 1 a diagramatic view of a series of potatoes 10 being forced along an enclosing tube 12, as by hydraulic pressure, and through the slicer blade 14 of the present invention. Exiting from the slicer blade 14, on the right as illustrated, are a cluster of cylindrically shaped potato strips 16 which ar produced for subsequent deep fat frying as "round French fries". Such multiple potato 10 slicing process is most likely to occur in commercial-type potato strip production facilities where the cylindrical potato strips 16 are produced in volume. The slicer blade 14 also would find use in less voluminous production, as at home, where potatoes 10 are introduced individually and are mechanically forced, as seen in FIG. 2, through the slicer blade 14 utilizing a pusher member 18 having protrusions 20 which are aligned with holes 22 in the slicer blade 14 to press the potato 10 completely through the slicer blade 14.

Figure 3:
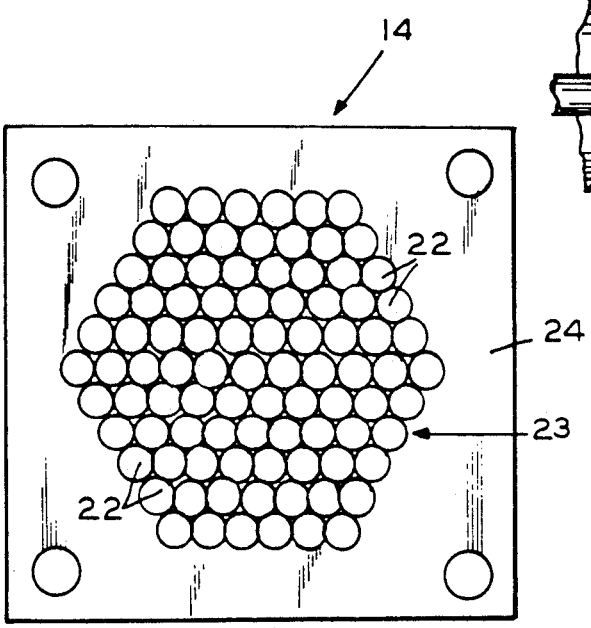
FIG. 3 illustrates a view of the slicer blade for cylindrical potato strips as seen at line 3-3 of FIG. 1.

A preferred embodiment of the slicer blade 14 for cylindrical potato strips 16 is best seen in FIG. 3. An arrangement of closely spaced cylindrical holes 22 are formed in and extend through a plate member 24. A convenient geometry for such arrangement of holes 22 is a hexagon 23, but is not so limited; the geometry of holes 22 used would be dependent on the form and size of the potato strip 16 producing apparatus. The plate member 24 may be formed of a variety of materials including stainless steel and high strength plastic. A thickness 26 of the plate member 24 of ⅜- to ½-inch appears to work well with minimum frictional losses. The holes 22 will normally range from ¼- to 1-inch in diameter, depending on the size of cylindrical potato strip 16, and subsequent French fry, desired.

Figure 4:
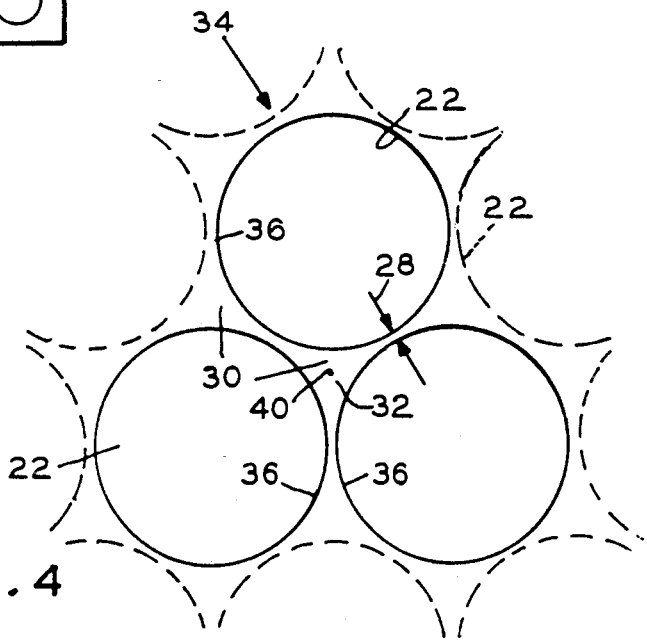
FIG. 4 illustrates an enlarged view of a cluster of holes before beveling.
Figure 5:
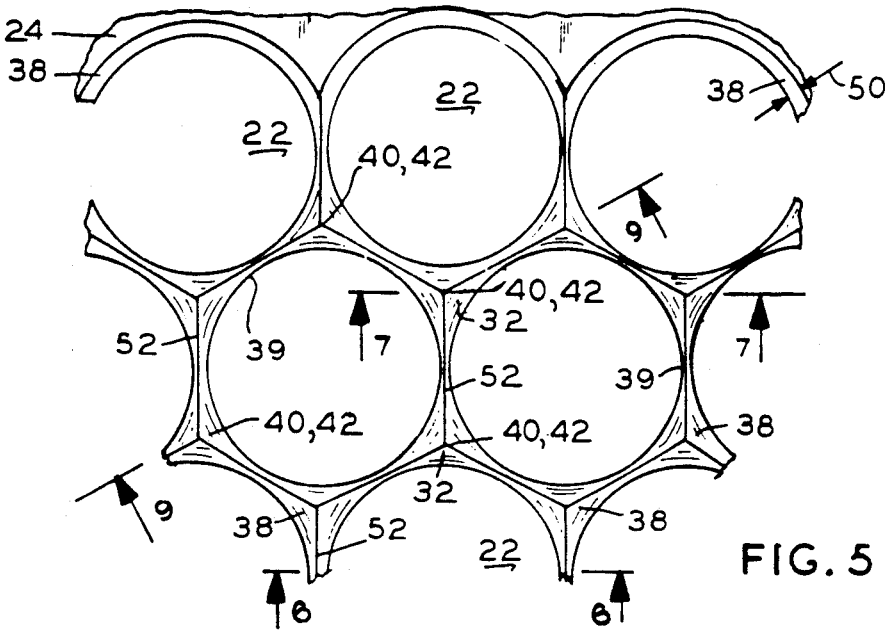
FIG. 5 illustrates an enlarged view of a portion of the holes in the slicer blade of FIG. 3.
Figure 6:
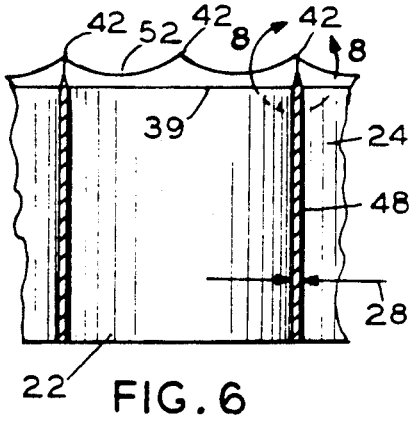
FIG. 6 illustrates a cross sectional view of the slicer blade as seen at line 6—6 of FIG. 5.
Figure 7:
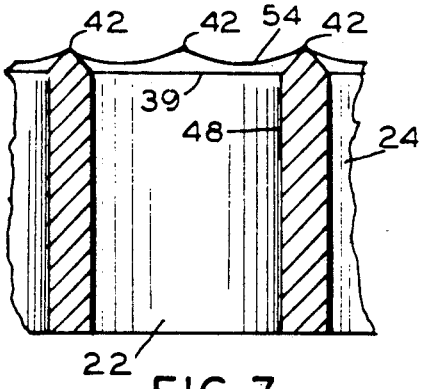
FIG. 7 illustrates a cross sectional view of the slicer blade as seen at line 7—7 of FIG. 5.
Figure 8:
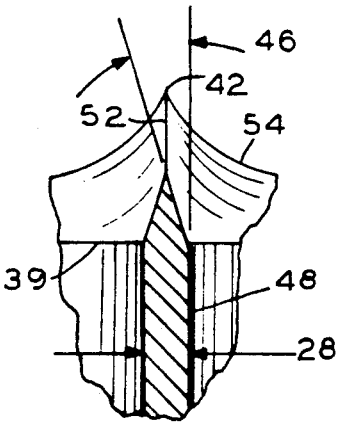
FIG. 8 illustrates an enlargement of a portion of the slicer blade as seen at line 8—8 of FIG. 6.
Figure 9:
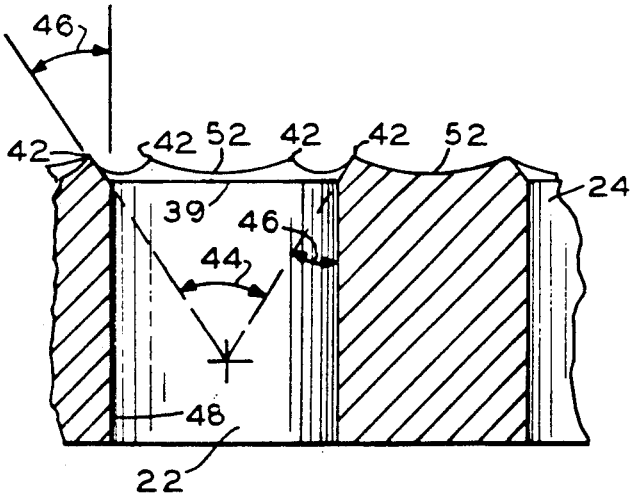
FIG. 9 illustrates a cross sectional view of the slicer blade as seen at line 9—9 of FIG. 5.

The holes 22 preferably are as close together as practicable, a preferred separation 28 being in the range of 0.010 to 0.015 inches. Should holes 22 merely be formed in a flat plate member 24 in close proximity to one another, it is clear, as seen in FIG. 4, that surfaces 30 of the plate member 24 which are flat would remain around and between the holes 22 which would impede the efficient slicing and passing through of a potato 10. In particular, a flat surface 30 in the roughly triangular area 32 between each cluster 34 of three holes 22 is especially undesirable. The flatness of this triangular area 32 is eliminated by beveling the edge 36 of each hole 22 producing the potato slicing configuration best seen in FIGS. 5–9. A beveling tool, such as a countersinking-type bit, is inserted into each hole 22 the same distance so that the bevel 38 extends to form intersection 39 with the inner surface 48 of the hole, and extends laterally to at least reach the center 40 of the triangular area 32. The triangular area 32 thus is transformed from a flat surface 30 into a three-sided sharp pointed peak 42, in a substantially tetrahedron shape. FIG. 5 provides a plan view of the effect of beveling. As best seen at the upper portion of the illustration where no adjacent holes 22 are located, the circular bevel 38 encircles each hole 22, the bevels 38 of a cluster 34 of three holes 22 meeting at the peak 42 at the center 40 of each triangular area 32. Using a beveling tool having a cutting angle 44 preferably in the range of 30 to 90 degrees, the angle 46 of the bevel 38 extending to the peak 42, as measured with respect to the longitudinal surface 48 of the hole 22, is 15- to 45-degrees. Since the bevel 38 extends laterally a distance 50 which is greater than the distance 28 separating the adjacent holes 22, the edges 52 between the holes 22 also become sharpened to the same angle 46 as the peak 42. Additionally, the sharpened edge 52 between each pair of adjacent holes 22 is formed with a concave shape 54 which extends curvilinearly upward to the sharp pointed peak 42.

Thus an arrangement of closely positioned holes 22 and a beveling of each hole 22 produces a sharp cutting edge 52 about the perimeter of each hole 22. With no flat surface 30 being transverse to the flow of a potato 10, the slicer blade 14 cleanly cuts each potato 10 into a number of cylindrical potato strips 16 with a minimum of pressure being applied to the potato 10 and with no internal waste.

It is thought that the slicer blade 14 of the present invention and its many attendant advantages will be understood from the foregoing description and that it will be apparent that various changes may be made in form, construction and arrangement of the parts thereof without departing from the spirit and scope of the invention or sacrificing all of its material advantages, the forms hereinbefore stated being merely exemplary embodiments thereof.

I claim:

1. A slicer blade for the preparation of cylindrically-shaped potato strips, comprising:

a. a plate member, having a plurality of cylindrical holes formed therethrough, which circularly intersect said plate member, said cylindrical holes being spaced in close proximity to adjacent cylindrical holes;

b. each said cylindrical hole, at said circular intersection with plate member, being formed with a bevel disposed continuously about said circular intersection, said bevel having a sloping surface which intersects sloping surfaces from adjacent cylindrical holes so as to form a sharp border between said cylindrical hole and adjacent cylindrical holes.

2. The slicer blade, as recited in claim 1, where the plurality of cylindrical holes includes a triangular cluster of three cylindrical holes, producing a substantially triangular-shaped area having a center point embraced by said cluster, said bevel of each cylindrical hole in said cluster having a sloping surface which extends at least to said center point of said triangular-shaped area, so as to form a three-sides sharp pointed peak.

3. The slicer blade, as recited in claim 1, wherein said cylindrical holes are uniformly spaced in close proximity to adjacent cylindrical holes.

4. The slicer blade, as recited in claim 3, wherein adjacent cylindrical holes are spaced in a range of 0.010 to 0.015 inches.

5. The slicer blade, as recited in claim 1, wherein the sloping surface of the bevel of each cylindrical hole, disposed continuously about the circular intersection of the cylindrical hole with the plate member, intersects substantially identical sloping surfaces of bevels of adjacent cylindrical holes.

6. The slicer blade, as recited in claim 5, wherein the sloping surface of the bevel is at an angle within a range of 45 t 75 degrees as measured from a plane defined by said circular intersection.

7. The slicer blade, as recited in claim 1, wherein each bevel extends substantially an equal distance into each said cylindrical hole.

8. The slicer blade, as recited in claim 1, wherein a total arrangement of cylindrical holes formed in the plate member is hexagonal in shape.

9. A slicer blade for the preparation of cylindrically-shaped potato strips, comprising:

a. a plate member, having a plurality of cylindrical holes formed therethrough, which circularly intersect plate member, said cylindrical holes being uniformly spaced in close proximity to adjacent cylindrical holes;

b. each said cylindrical hole, at said circular intersection with said plate member, being formed with a bevel continuously disposed about said circular intersection, said bevel extending substantially an equal distance into each said bevel extending substantially an equal distance into each said cylindrical hole and having a sloping surface which intersects substantially identical sloping surface from adjacent cylindrical holes so as to form a sharp border between said cylindrical hole and adjacent cylindrical holes; and c. said plurality of cylindrical holes including a triangular cluster of three cylindrical holes, producing a substantially triangular-shaped area having a center point embraced by said cluster, said bevel of each cylindrical hole in said cluster having a sloping surface which extends at least to said center point of said triangular-shaped area, so as to form a three-sided sharp pointed peak.

* * * * *